United States Patent [19]

Hacker

[11] Patent Number: 4,502,365

[45] Date of Patent: Mar. 5, 1985

[54] SOCKET WRENCH EXTENSION

[76] Inventor: Karl M. Hacker, 1921 Dover La., Castleton, N.Y. 12033

[21] Appl. No.: 414,291

[22] Filed: Sep. 2, 1982

[51] Int. Cl.[3] ..... B25B 13/00

[52] U.S. Cl. ..... 81/177 G; 81/177 A

[58] Field of Search ..... 81/177 G, 177 A; 279/82; 403/365, 368

[56] References Cited

U.S. PATENT DOCUMENTS

| | | | |
|---|---|---|---|
| 1,864,466 | 6/1932 | Peterson | 81/177 G X |
| 3,924,493 | 12/1975 | Penner | 81/177 G |
| 4,297,924 | 11/1981 | Stephens | 81/177 G X |
| 4,399,722 | 8/1983 | Sardo | 81/177 G X |

*Primary Examiner*—James G. Smith

*Attorney, Agent, or Firm*—Heslin, Watts & Rothenberg

[57] ABSTRACT

A socket wrench extension for effecting a quick release and simultaneous removal of a socket. The extension has a shaft with an attachment located at one end of the shaft adapted to connect to the socket wrench drive and a stud located at the other end for connecting to the socket. A sleeve is rotatably and slideably mounted on the shaft for moving a detent between a released and a locked position. The sleeve also simultaneously releases and urges the socket off the extension.

8 Claims, 2 Drawing Figures

SOCKET WRENCH EXTENSION

BACKGROUND AND SUMMARY OF THE INVENTION

This invention relates to socket wrenches and more particularly to a socket wrench extension which is adapted to positively lock sockets in place on the extension.

Socket wrenches have become widely used in virtually every industry in the country. In its simplest form a socket wrench is an elongated device, commonly referred to as a drive, having one end adapted to receive a socket. Since the inception of the socket wrench, there have been a number of changes and improvements on this main idea. One such addition to the standard socket wrench was the development of extensions of various lengths. These extensions are placed between the socket and the wrench and allow the user to apply the socket to bolts or the like which, due to their location, would normally have been difficult to work on.

When the socket is attached directly to the drive, the combination is quite easy to manipulate. Due to the direct contact, one can apply a significant amount of downward pressure while working the wrench thus helping to maintain the socket on the bolt. Similarly, should the socket slip off of the bolt or if the socket disconnects from the drive, the close proximity of the drive to the socket makes it easy to reconnect the socket to either the drive or the bolt. With the advent of wrench extensions, the unintentional disconnecting of the socket from either the extension or the bolt became more frequent and their attachment more difficult. Attempts to solve this problem at least partially, by pinning the socket to the extension, proved to be time consuming and therefore not desirable. Also, where a pin is used, there is always the problem of its being lost or misplaced which is a common occurrence in an automotive garage.

The development of the present invention came out of my endeavors as both an auto mechanic and a race car driver. In both of these situations, one's success is ofttimes dependent upon the speed with which repairs can be performed without sacrificing quality. A number of factors go into the speed of repair such as experience and automotive knowledge. Nevertheless, I have found that the most effective way to speed repairs, either on or off the track, is through the development of more efficient tools.

One of the most frequently used tools in making automotive repairs is the socket wrench which is often used with an extension. The difficulties in using socket tools and extensions as described above have been experienced by virtually every mechanic in the automotive field. Personlly, I found that the difficulties encountered when working with socket extensions were so time consuming that I began welding some of the more commonly used sockets and extensions together. Of course, this only solved part of the problem and was also quite expensive since a separate extension was required for each socket.

With these things in mind I began working on the present invention. One of my objects being to develop an extension wherein the socket would positively lock onto the extension and not become separated unintentionally.

Another object of my invention was to provide an extension which was easier to hold in place while it is being rotated.

Another object of my invention was to have an extension wherein the socket could be released and removed with one hand.

Yet another object of my invention was to provide an extension wherein the socket could be mounted on the extension with one hand.

Still another object of this invention was to provide an extension wherein the socket would not only be released but would also be simultaneously urged off of the extension.

Another object of this invention was to provide an extension which was easy to disassemble for cleaning purposes.

Briefly described, the present invention is a socket extension having a shaft, an attachment located on one end of the shaft adapted to connect to the drive of a socket wrench, and a receiving member located on the other end of the shaft which is adapted for the connection of sockets. A control means mounted on the shaft is operatively connected to a detent within the receiving member. The control means operates to either release or positively lock the socket onto the receiving member by moving the detent partially outside of the receiving member or drawing it substantially within the receiving member. In one embodiment the control means also serves to initiate the removal of the socket while simultaneously releasing the socket.

DETAILED DESCRIPTION OF THE DRAWINGS

Figure 1:
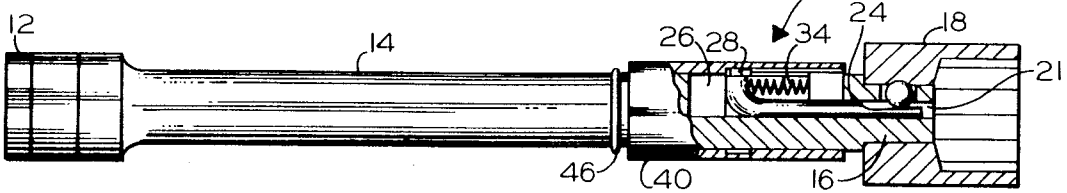
FIG. 1 is a side elevation view of the invention with a portion of the socket release mechanism broken away to disclose its operative features.
Figure 2:
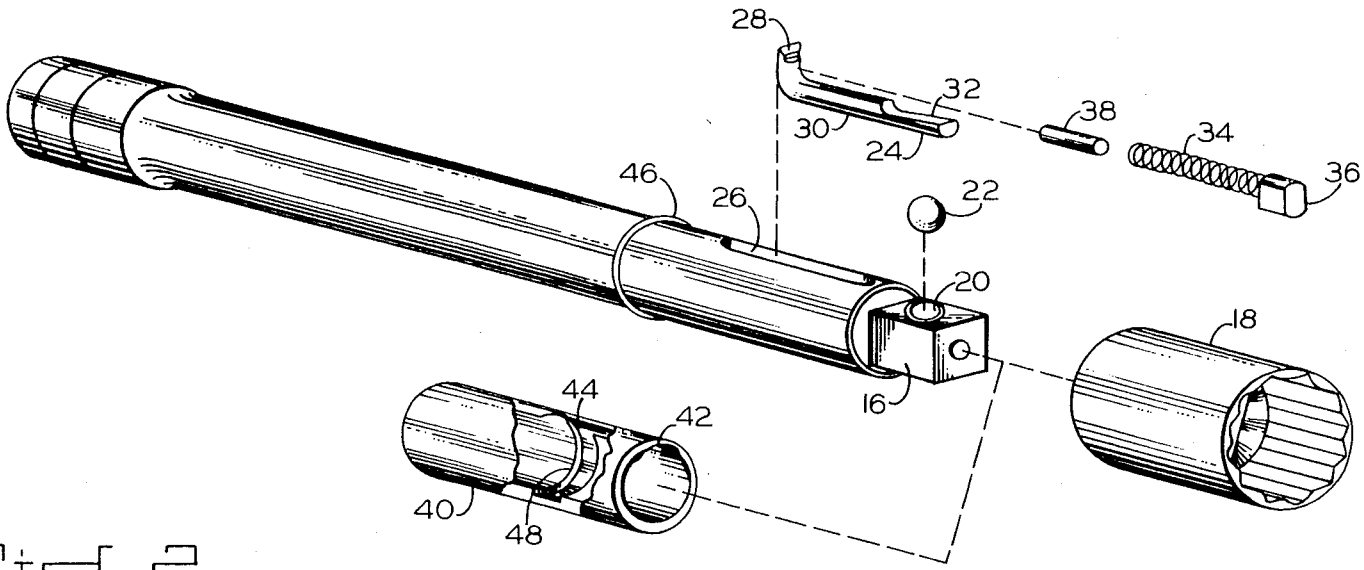
FIG. 2 is a front perspective view of the invention in its disassembled state also showing a portion of the sleeve broken away thereby disclosing the inner grooves.

FIG. 1 shows the socket wrench extension generally designated as 10. The extension 10 consists of an attachment member 12 at one end of the extension which is suitable for connection to the drive of a standard socket wrench (not shown). Proceeding from the attachment 12 one next encounters the shaft 14 of the extension. The other end of the extension terminates at a stud 16 which is of a standard size for insertion into a socket 18. (See FIG. 2). For the purpose of this disclosure elements or movements toward the connector 12 will be considered rearward and toward the stud will be considered forward.

The mechanism for positively locking the socket 18 onto the stud 16 consists of a circular opening 20 in the stud and a detent or ball 22 which resides in a cavity 21 below the circular opening 20. The diameter of the ball is greater than the circular opening such that the ball can only extend partially out of the opening. This ball, of course, could be replaced by numerous types of detents which would be designed to protrude out of the stud 16.

A slide pin 24 resides in a holding channel 26 which is cut into the shaft 14. The holding channel 26 communicates with the cavity 21 in which the ball resides and when properly positioned, the slide pin 24 extends along the channel and beneath the ball.

The slide pin 24 is L-shaped having a projection 28 which extends vertically to and above the holding channel. Slide pin 24 also consists of an elongate portion 30 which travels along the channel and extends beneath the ball 22. The part of the elongate portion 30 which extends below the ball forms an incline 32. Thus, as the slide pin 24 travels along the channel, the ball 22 rides either up or down the incline thereby causing it to reside either substantially within the stud or else extend without the circular opening 20. When the ball extends out of the circular opening, a socket placed on the stud 16 will be positively locked onto the extension. This positive locking feature secures the socket to the extension so that it cannot be removed simply by pulling the tool apart. Instead, the incline 32 acts as a wedge thus supporting the ball with metal to metal solid contact.

In my preferred embodiment the incline 32 is fashioned such that the socket is released when the slide pin is moved along the channel toward the stud which I refer to as the "advanced position" of the slide pin. Similarly, the socket is positively locked onto the stud when the slide pin is slid along the channel toward the connector 12 to its "retracted position".

A spring 34, under tension, is placed within the channel 26 between the projection 28 and the forward end wall of the channel. The portion of the spring which presses against the forward end wall rests in a head 36. Thus, the spring biases the slide pin to its retracted position. When the slide pin is moved towards its advanced position, the spring contracts. This contraction, however, is limited by a spacer 38 within the spring which determines the maximum advanced position to insure that the ball 22 will always engage a portion of the incline 32.

A sleeve 40 is mounted around the shaft 14. This sleeve, in its operative positions covers the channel 26.

There are two grooves in the inside of the sleeve. The first is a longitudinal groove 42 which runs from the forward end of the sleeve to approximately the middle of the sleeve. At the middle of the sleeve, the longitudinal groove 42 communicates with an annular groove 44 which runs completely around the inside of the sleeve. When in its operative position, the portion of projection 28 which extends beyond the channel rides within the annular groove 44 so as to enable the sleeve to rotate about the extension shaft. The rotatability of the sleeve allows one to grasp said sleeve while rotating the extension thus allowing for some forward pressure to be put on the sleeve to maintain the socket on its work piece while not pushing so hard as to release the socket.

As previously mentioned, the spring 34 within channel 26 presses against the projection 28 of the slide pin 24 thereby biasing it to its retracted position. In this retracted position, the projection 28 presses against the rear wall 48 of the annular groove 44 thereby biasing the sleeve 40 to its rearward position against a snap ring 46 which is fit around shaft 14. When these pieces are so biased the detent 22 rests upon the uppermost portion of the incline 32 and thus the detent extends without the circular opening 20 in stud 16. To mount the socket 18, the sleeve 40 is moved to its forward position thereby moving the slide pin to its advanced position such that the detent is lowered as it travels down the incline coming to rest substantially within the stud 16. At this point the socket 18 is slid over the stud until it contacts the sleeve 40. Both the sleeve and the socket are then moved rearwardly causing the detent to extend without the opening 20 as the socket moves into place thereby positively locking socket 18 onto stud 16. When releasing the socket the sleeve is moved to its forward position thereby lowering detent 22 within the stud. As the sleeve moves forward, it encounters the socket 18 such that the socket is simultaneously unlocked and pushed in a forward direction off of the stud.

To disassemble this invention, the snap ring 46 is simply slid toward the attachment member 12 thereby allowing the sleeve 40 to be moved rearwardly. This reveals the channel 26 in which the slide pin 24, spring 34, head 36 and spacer 38 reside. Thus, these pieces can be removed for cleaning or repair. Once reinserted, the sleeve is slid forward toward the stud 16 such that the projection 28 of the slide pin 24 travels along the longitudinal groove 42 on the inner surface of the sleeve. As the sleeve is moved forward, the projection 28 enters the annular groove 44 which travels around the inside of the sleeve, and the projection 28 comes to rest against the rear wall 48 of the annular groove. The sleeve is then moved slightly forward so as to maintain tension between the projection 28 and the rear wall 48. The snap ring 46 is then moved up behind the sleeve and into a prepositioned groove (not shown).

It should be noted that while this is the preferred embodiment, numerous other alterations could be made. For example, the action between the slide pin and the sleeve could be reversed such that the movement of the sleeve to its rearward position would unlock the socket. Thus, while the sleeve can be held in either case while the extension is rotating, in this latter configuration, more forward pressure could be applied to the sleeve to hold the socket more securely to the work piece to which it is being applied. While there are other modifications too numerous to mention, suffice it to say that this invention should only be limited by the appended claims.

What is claimed:

1. An extension for use with the drive member of a socket wrench system for positively holding a socket in place, comprising:

a shaft of predetermined length;

means on one end of the shaft for receiving a socket;

means on the other end of the shaft for operatively attaching the extension to the drive member;

means for securing the socket onto the receiving means, said means being operable between a first position for positively locking the socket to the extension member and a second position for releasing the socket from the extension member; and control means located on the shaft for operating said securing means between said locking and releasing positions, said control means includes means for urging the socket from the receiving end while simultaneously moving the securing means to its releasing position.

2. The invention of claim 1 wherein said control means is adapted to be operable by a single human hand gripping the shaft.

3. The invention of claim 1 or 2 wherein the control means is rotatably mounted on the shaft to allow for independent rotation of the shaft and the control means with respect to one another.

4. The invention of claims 1 or 2 wherein said securing means comprises:

a detent located in the receiving means, said detent protruding out of said receiving means when the securing means is in the locking position so as to engage the socket and said detent residing substantially within the receiving means when the securing means is in its released position.

5. The invention of claim 4 further comprising:

a slide pin mounted within the shaft and extending into the receiving means, said slide pin being movable between an advanced and retracted position, said detent resting upon the slide pin so that the advanced position of the slide pin corresponds to the released position of the securing means and the retracted position of the slide pin corresponds to the locked position of the securing means.

6. The invention of claim 5 wherein said urging means further comprises:

a sleeve both slideably and rotatably mounted on the shaft, said sleeve sliding between a forward and a rearward position and engaging the slide pin such that the movement of the sleeve between its forward and rearward positions causes the corresponding movement of the slide pin between its advanced and retracted positions respectively.

7. The invention of claim 6 wherein the slide pin is biased to its retracted position and the sleeve is biased to its rearward position.

8. The invention of claim 1 or 2 wherein said control means is proximally located with regard to the receiving end such that a single human hand can engage said control means and simultaneously grasp a socket on the receiving end.

* * * * *